US005269049A

United States Patent [19]

Gustafsson et al.

[11] Patent Number: 5,269,049

[45] Date of Patent: Dec. 14, 1993

[54] PROCESS AND APPARATUS FOR DRY FORMING OF A MATERIAL WEB FROM A LONG-FIBER MATERIAL

[75] Inventors: Helmer Gustafsson; Pentti Pirinen, both of Valkeakoski, Finland

[73] Assignee: Yhtyneet Paperitehtaat Oy, Walkisoft Engineering, Valkeakoski, Finland

[21] Appl. No.: 947,759

[22] Filed: Sep. 9, 1992

[30] Foreign Application Priority Data

Sep. 18, 1991 [FI] Finland ..... 914384

[51] Int. Cl.[5] ..... D04H 1/72

[52] U.S. Cl. ..... 19/304; 264/121; 264/518

[58] Field of Search ..... 264/121, 517, 518; 19/297, 302, 304, 307, 308

[56] References Cited

U.S. PATENT DOCUMENTS

| | | | |
|---|---|---|---|
| 4,264,290 | 4/1981 | Dumkerly, II et al. | 264/121 X |
| 4,268,235 | 5/1981 | Bean et al. | 425/83.1 |
| 4,276,248 | 6/1981 | Widnall | 264/121 |
| 4,482,308 | 11/1984 | Johnson | 425/83.1 |
| 4,640,810 | 2/1987 | Laursen et al. | 264/518 |
| 4,662,032 | 5/1987 | Thorbjörnsson | 19/304 X |
| 4,701,294 | 10/1987 | Radwanski et al. | 264/518 |
| 4,927,582 | 5/1990 | Bryson | 264/121 X |
| 5,028,224 | 7/1991 | Pieper et al. | 19/304 X |
| 5,056,195 | 10/1991 | Furtak et al. | 19/304 |

FOREIGN PATENT DOCUMENTS

| | | | |
|---|---|---|---|
| 0006327 | 1/1980 | European Pat. Off. . | |
| 0032772 | 7/1981 | European Pat. Off. . | |
| 2702361 | 7/1977 | Fed. Rep. of Germany . | |
| 881298 | 10/1988 | Finland . | |
| 881299 | 10/1988 | Finland . | |
| 881300 | 10/1988 | Finland . | |
| 357288 | 12/1972 | U.S.S.R. | 19/302 |

*Primary Examiner*—Clifford D. Crowder
*Assistant Examiner*—John J. Calvert
*Attorney, Agent, or Firm*—Young & Thompson

[57] ABSTRACT

The invention relates to a process and an apparatus for the dry forming of a material web from a long-fiber material, wherein fibrous material is blown into a forming space to form a porous material web on a wire passing through the forming space. The dry forming of long fibers in lengths of at least 20 mm is problematic. In accordance with the invention, this problem has been solved in such a way that the fibrous material is blown into the forming space by at least one air current (A) that is substantially horizontal and transverse to the wire, the fibrous material is guided onto the surface of the wire (1) by an air current (D) that is substantially vertical and passes through the wire downwardly, and the desired material web (F) is formed by the combined effect of said horizontal and vertical air currents.

13 Claims, 2 Drawing Sheets

PROCESS AND APPARATUS FOR DRY FORMING OF A MATERIAL WEB FROM A LONG-FIBER MATERIAL

BACKGROUND OF THE INVENTION

1. Field of the Invention

The present invention relates to a process and an apparatus for the dry forming of a material web from a long-fiber material, wherein fibrous material is blown into a forming space to form a porous material web on a wire passing through the forming space.

2. Description of the Related Art

In dry forming processes, such as dry paper-making machines, special forming parts for the screening and processing of the fibrous material are employed, wherein a uniform material web is produced on the wire by employing and regulating various mechanical screens, cleaning and mixing devices, and air currents. Thereafter a bonding agent is sprayed onto the material web, and the web is transported into a heating zone wherein the bonding agent melts and adheres to the fibers, bonding them together into a firm paper product.

The number and shape of perforations in the mechanical screens, such as forming drums, as well as the shape and other similar properties of the screens employed in the forming parts referred to above are of crucial importance for the quality of the material web and thereby for the final product. An inherent quality in the screens is that the higher the average fiber length in the raw material, the more critical the selection of a correct screen and correct use of the screen. This is a matter of current interest particularly in view of the present-day dry-formed products based on long synthetic fibers. While the average length of wood fibers is 2 to 6 mm, synthetic fibers may in principle have an infinite length, but with the present technology it should be possible to dry-form webs of synthetic fibers having a maximum length of 20 to 25 mm. However, this requires a fairly complicated forming machinery having a manifold forming unit and complex tubing and recycling equipment. In this regard, reference is made to European Patent 188 454.

One concrete set of problems is presented by the manufacture of GMT (Glass Mat Thermoplastics) products. The car industry, in particular, currently uses more than 25,000 tons of GMT parts per annum, and the consumption is forecast to increase to 60,000 by 1995. The advantage of GMT products over thermosetting plastics is the possibility of reusing the products. Glass fiber is normally used as reinforcing fiber, and polypropylene is used as the raw material for the matrix.

The strength of GMT products is influenced for instance by the proportion of reinforcing fibers in the product, the length of the reinforcing fibers, and the surface finishing thereof. With a 30% glass fiber content, the tensile strength obtained for the product is approximately 70 MPa/mm$^2$. With rock fibers, i.e. mineral fibers, a tensile strength of 30–40 MPa/mm$^2$ can be obtained, respectively. As research proceeds and special materials are employed, the strength values can be expected to further increase significantly. The GMT product range comprises for instance in the car industry bumpers, seats, control panels, etc.

The GMT production processes currently employed are based on coating a material web with a matrix-forming substance (Continuous Melt Impregnation Process) or on laying a material web in a bonding agent suspension (Continuous Slurry Deposition Process). Modifications of these, as well as totally new processes are being developed continually as the demand increases and the production technology is mastered. However, in all GMT processes at least the forming of the reinforcing fiber component into a material web of a uniform quality is necessary. When the glass fiber length is in the order of 50 mm, even up to 60 mm, it is obvious that conventional dry forming parts are not capable of adequate processing of the fibers. It has been found that enlarging the perforations in a screen member in principle improves the screening of long fibers onto the material web, but when the perforations have sufficient size, the screen loses its screening and distribution capability completely. Therefore, the forming technology of a material web must be developed starting from a totally new basis. In GMT products, the fiber length is not an end in itself, but the strength and bonding properties determine the minimum lengths of the fibers employed. It is obvious that very short fibers cannot be employed irrespective of their possible strength, since they do not extend to sufficiently many points of contact, i.e. bonding points, with other fibers in order for the bonded product to have sufficient strength. Thus it can be assumed that the average length of the fibrous material to be formed into a material web, or of a fiber component therein, is at least about 20 mm.

SUMMARY OF THE INVENTION

The above facts have given rise to the need for providing a process and an apparatus suitable for the dry forming method which impose no strict limitations on the length of the fibrous raw material employed and by which material webs can be formed of fibers or fiber mixtures including very long fibers as compared with those employed in the present technology.

To produce this effect, the process of the invention is characterized in that the fibrous material is blown into the forming space by means of at least one air current that is substantially horizontal and transverse to the wire, the fibrous material is guided onto the surface of the wire by means of an air current that is substantially vertical and passes through the wire downwardly, and that the desired material web is formed by the combined effect of said horizontal and vertical air currents.

The most significant advantages of the invention are almost total insensitivity to fiber length, absence of moving parts in the forming space with the exception of the wire, and almost unlimited possibilities of process control. The basic idea of the invention lies in recognizing the problems of the forming part for long fibers and drawing conclusions therefrom on the one hand, and on the other hand carrying the possibilities afforded by dry forming to the extreme, that is, omission of screening or similar mechanical treatment of the fibers entirely, as the fibers can be treated by means of air currents. This is not a self-evident outcome, as mechanical screening drums as well as cleaning and guiding means are essential in the forming parts for shorter fibers, particularly those susceptible to bundle formation.

In a preferred embodiment of the invention, part of the fibers are recycled out from the forming space and back thereinto. This is essential in forming spaces where otherwise a danger of blockage exists. Further, as will be seen hereinafter, recycling affords the possibility of achieving a uniform material web more easily.

BRIEF DESCRIPTION OF THE DRAWINGS

The invention will now be described in closer detail by means of examples with reference to the accompanying drawings, in which.

DETAILED DESCRIPTION OF THE PREFERRED EMBODIMENTS

Figure 1:
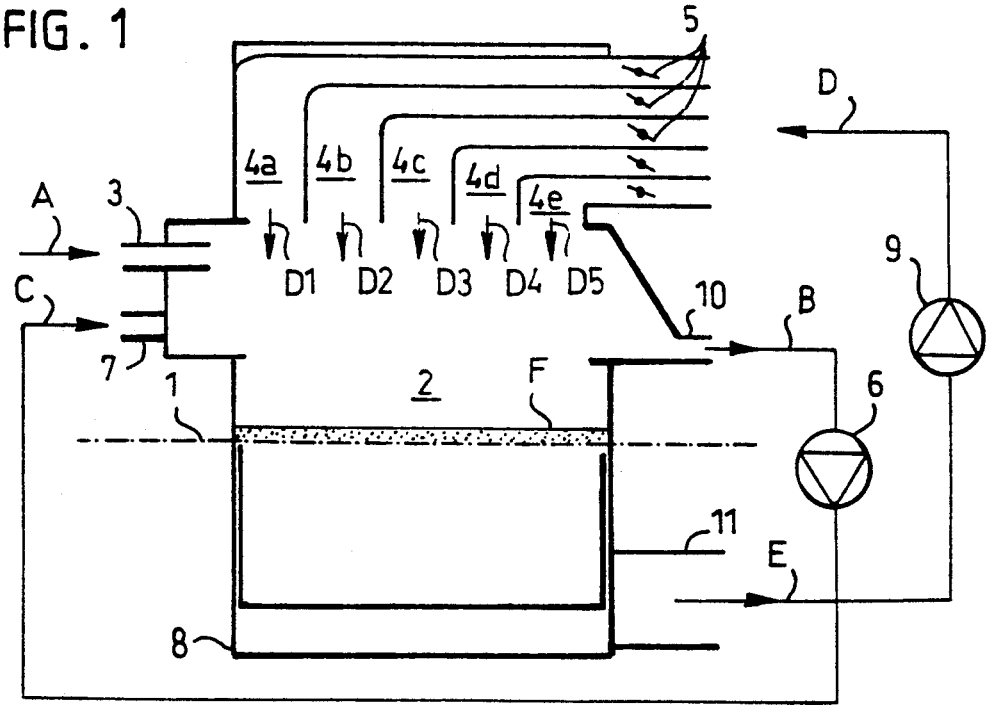
FIG. 1 is a lateral cross-sectional view of a forming apparatus of the invention.

FIG. 1 shows a forming apparatus of the invention, wherein a long-fiber material, in this exemplary case glass fiber of a length of about 50 mm, is supplied to form a porous web onto a wire 1 passing through a forming space (arrow A, primary feed of fibrous material). The fibrous material is blown into the forming space 2 through pipe fitting 3 by means of a horizontal air current A transverse to the wire. The air flow rate is one of the adjustable variables in the forming process of the invention, and it may be in the order of 25 m/s. The grammage of the web to be formed may be 500–3000 g/m$^2$, for instance.

The fibrous material is guided to the surface of the wire by means of a vertical air current D from above, extending across the wire. The vertical air current is divided by means of guiding ducts 4*a*–4*e* into fractions $D_1$–$D_5$ acting on different points in the transverse direction of the wire. The guiding ducts are controlled by regulating means 5 wherewith the air current in each conduit can be separately adjusted to permit regulation of the air current intensity profile in the transverse direction of the wire so as to produce an optimally uniform transverse profile for the material web. It is advantageous but not indispensable that the air current E exhausted from a suction box 8 provided underneath the wire be recycled from opening 11 through a fan 9 back into the vertical air current D. Since the discharged air current E is hot, this arrangement may cause excessive heating of the supply air for instance in tropical conditions, and in that case fresh air should at least partly be taken in with the supply air.

The desired material web F is formed by the combined action of said horizontal and vertical air currents, as the air currents collide above the wire 1. Part of the fibers carried by the horizontal primary current into the forming space are removed (arrow B) from the forming space through pipe fitting 10 and recycled by means of fan 6 back into the forming space as a secondary fiber feed C from pipe fitting 7 located on the same side as the pipe fitting 3 for the primary supply, but lower than this. The last-mentioned fact is significant for the uniformity of the web being formed, the grammage of which will otherwise easily be too low beneath the pipe fitting 3. According to a preferred embodiment of the invention, the forming apparatus is so constructed that the material web F is formed in accordance with FIG. 2 in forming units I and II arranged in pairs and operating in reverse phases. Thus there are at least two forming spaces, wherein at least the primary feed of fibers comes from opposite directions into the forming spaces. It is easy to produce a web of a uniform quality on the entire width of the web by means of forming parts operating symmetrically in this way.

Figure 3:
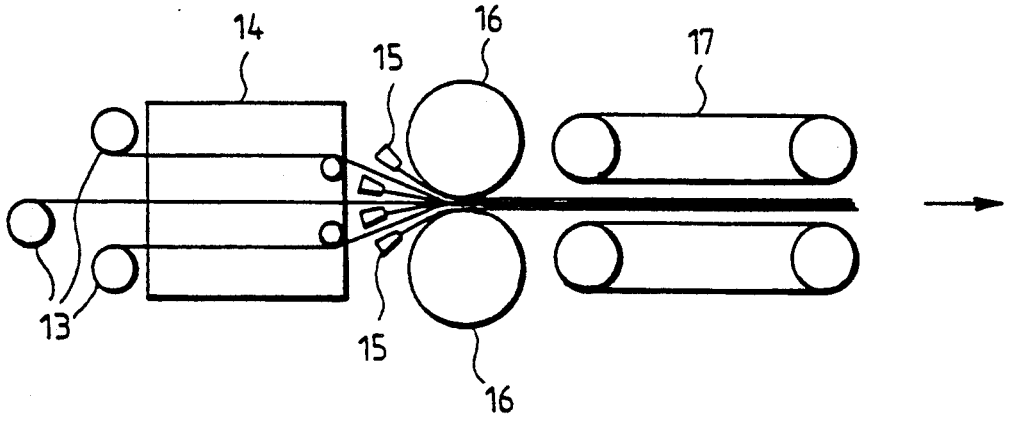
FIG. 3 shows an embodiment of a forming process of the invention.

The completed web F is bonded in a flow-through drier, for instance, whereafter it is removed from the drier wire and wound on a roll for further processing, such as GMT processing (cf. FIG. 3).

Figure 2:
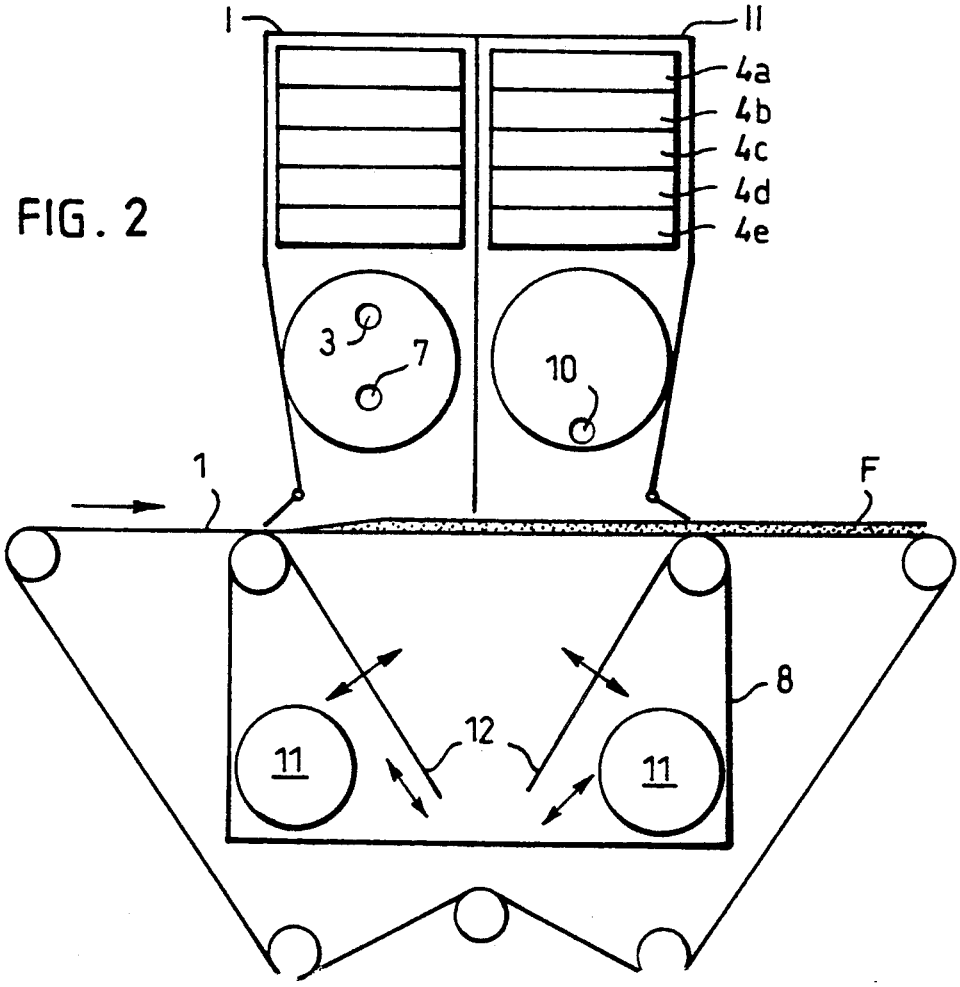
FIG. 2 is an end cross-sectional view of the forming apparatus of the invention.

FIG. 2 shows the construction of the suction box 8 in closer detail. The suction box incorporates longitudinal air current guide plates 12 wherewith the distribution of air in the suction box and its discharge can be regulated. The regulation is performed by inclining the plates and/or extending them in the direction of the arrows, so that the gap between the lower edge of the plates and the bottom of the suction box 8 changes. The regulation has the purpose of equalizing the vertical air current in the forming space by producing an air current distributed as uniformly as possible through the web F into the suction box.

Webs formed by the process in accordance with the invention may be formed from glass fibers only, bonded with a suitable bonding agent, e.g. one based on thermoplastic, under the influence of heat. The fibers may also consist of a mixture of glass fiber and mineral fiber, i.e. rock fiber, wherein the mineral fibers primarily serve as a filler, or for instance of a bicomponent fiber comprising a PP fiber coated with a PE layer, for instance. In the final product, the PP fiber forms a reinforcement and the PE layer is fused, bonding the reinforcing fibers together. The bonding may also be provided in a variety of other conventional ways, like mixing thermoplastic bonding fibers with the glass fibers, spraying the web with a bonding agent, or immersing the fibers in a bonding agent dispersion ahead of the web forming part. In accordance with a preferred embodiment of the invention, the average length of the fibrous material to be formed into a material web or a fiber component therein is at least about 20–60 mm.

FIG. 3 shows an embodiment of the forming process of the invention, wherein a GMT product is formed by a continuous melt impregnation process. The steps in the GMT process are:

laying a porous web 13, for instance by the process and apparatus of the invention, glass fiber (for example 30% of the weight of the final product) and a suitable bonding agent being the raw materials, preheating of the web in a furnace 14, coating and/or impregnation of the web by thermoplastic (polypropylene) by means of nozzles 15, and compression between press rolls 16, consolidation step, that is, smoothing step on a compression track 17, whereafter the product is cut into sheets and transported to stock.

Figure 4:
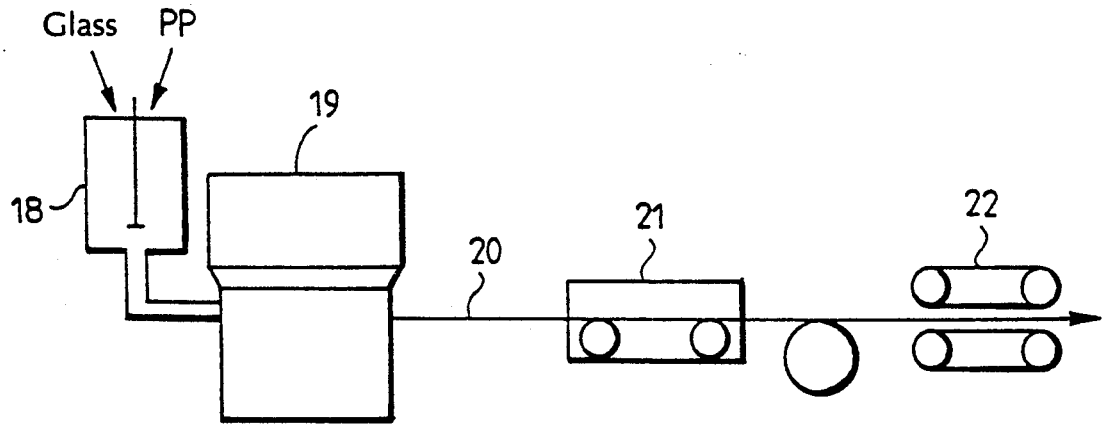
FIG. 4 shows another embodiment of the forming process of the invention.

FIG. 4 shows another embodiment of the forming process of the invention, wherein a GMT product is formed by mixing glass fiber and polypropylene fiber. In this case, the steps are the following:

mixing of the fibers in a mixer 18, laying of a porous web 20 with the apparatus 19 of the invention, bonding of the web in a flow-through furnace 21, consolidation step, that is, smoothing step on a compression track 22, whereafter the product is cut into sheets and transported to stock.

It is clear to one skilled in the art that the different embodiments of the invention are not limited to the examples set forth above, but they can vary within the scope of the ensuing claims. Thus, the fibrous material to be treated is in no way restricted to glass or polypropylene fibers or any other material or mixtures thereof, but the fiber length of at least one fiber component in the material to be formed into a web is essential to the invention.

We claim:

1. A process for dry-forming a desired material web from a long-fiber material, comprising the steps of:
   passing a wire through a forming space;
   blowing fibrous material into the forming space by at least one primary air current that is blown substantially horizontal and transverse to the wire;
   guiding the fibrous material onto a surface of the wire by a separate independently controlled air current that is blown substantially vertical and passes through the wire downwardly; and
   forming the desired material web by a combined effect of the horizontal primary air current colliding perpendicularly with the independently controlled vertical air current.

2. The process as recited in claim 1, further comprising the steps of:
   dividing the independently controlled vertical air current by ducts into fractions acting on different points in a direction transverse to the wire;
   adjusting the ducts to regulate an air current intensity profile in the direction transverse to the wire; and
   producing an optimally uniform profile for the desired material web.

3. The process as recited in claim 1, further comprising the steps of:
   operating two successive forming spaces in pairs;
   feeding the desired horizontal primary air current into the two successive forming spaces from opposite directions; and
   forming the material web in the two successive forming spaces.

4. The process as recited in claim 1, further comprising the steps of:
   providing a horizontal primary feed line for the fibrous material to enter the forming space with the horizontal primary air current;
   providing a separate feed line for the vertical air current to enter the forming space;
   removing at least part of the fibrous material carried by the horizontal primary air current from the forming space; and
   recycling at least part of the fibrous material removed from the forming space back into the forming space through a secondary fiber feed line located adjacent to the horizontal primary feed line.

5. The process as recited in claim 4, further comprising the steps of:
   providing a suction box beneath the wire in the forming space; and
   recycling the vertical air current from the suction box back into the forming space through the separate feed line.

6. The process as recited in claim 5, further comprising the steps of:
   equalizing the vertical air current in the forming space and in the suction box; and
   regulating distribution of air in and discharge of air from the suction box by adjusting an opening between longitudinal guide plates.

7. The process as recited in claim 1, further comprising the steps of:
   providing preliminary fibrous material having an average length for each fiber component therein of at least about 20 to 60 millimeters.

8. An apparatus for dry-forming a desired material web from a long-fiber material, comprising:
   a forming space;
   a wire passing through the forming space;
   means for blowing fibrous material into the forming space by at least one primary air current that enters said forming space substantially horizontal and transverse to the wire; and
   means for guiding the fibrous material onto a surface of the wire by a separate independently controlled air current that is blown substantially vertical and passes through the wire downwardly;
   wherein the desired material web is formed by a combined effect of the horizontal primary air current colliding perpendicularly with the independently controlled vertical air current.

9. The apparatus according to claim 8, further comprising:
   duct means for dividing the independently controlled vertical air current into fractions acting on different points in a direction transverse to the wire; and
   means for adjusting the duct means to regulate an air current intensity profile in the direction transverse to the wire, whereby an optimally uniform profile is produced for the desired material web.

10. The apparatus according to claim 8, further comprising:
   means for operating two successive forming spaces in pairs; and
   means for feeding the horizontal primary air current into the two successive forming spaces from opposite directions;
   wherein the desired material web is formed in the two successive forming spaces.

11. The apparatus according to claim 8, further comprising:
   a primary line means for feeding the fibrous material into the forming space with the horizontal primary air current;
   a secondary line means for feeding part of the fibrous material back into the forming space;
   means for removing at least part of the fibrous material carried by the horizontal primary air current from the forming space; and
   fan means for recycling at least part of the fibrous material removed from the forming space back into the forming space through the secondary line means.

12. The apparatus according to claim 11, further comprising:
   a suction box provided beneath the wire in the forming space; and
   fan means for recycling the vertical air current from the suction box back into the forming space.

13. The apparatus according to claim 12, further comprising:
   means for equalizing the vertical air current in the forming space in the suction box;
   longitudinal guide plate means for regulating distribution of air in and discharge of air from the suction box; and
   means for adjusting an opening between said longitudinal guide plate means.

* * * * *